United States Patent [19]

Beynet et al.

[11] 3,978,804

[45] Sept. 7, 1976

[54] RISER SPACERS FOR VERTICALLY MOORED PLATFORMS

[75] Inventors: Pierre A. Beynet; David A. Dixon, both of Tulsa, Okla.

[73] Assignee: Amoco Production Company, Tulsa, Okla.

[22] Filed: Oct. 15, 1973

[21] Appl. No.: 406,434

[52] U.S. Cl. ..... 114/.5 D; 61/98

[51] Int. Cl.[2] ..... B63B 35/44

[58] Field of Search ..... 114/.5 R, .5 D, 206 R; 61/46.5; 175/7; 9/8 P

[56] References Cited

UNITED STATES PATENTS

| | | | |
|---|---|---|---|
| 3,316,984 | 5/1967 | Jones | 175/7 |
| 3,366,088 | 1/1968 | Gibson | 9/8 P |
| 3,572,272 | 3/1971 | Dixon et al. | 114/.5 D |
| 3,648,638 | 3/1972 | Blenkarn | 114/.5 D |
| 3,733,834 | 5/1973 | Ludwig | 175/7 |

*Primary Examiner*—Duane A. Reger
*Assistant Examiner*—Jesus D. Sotelo
*Attorney, Agent, or Firm*—John D. Gassett

[57] ABSTRACT

This invention relates to a structure floating on a body of water, and particularly a structure for drilling or producing wells from below the water. Buoyant members support at least a part of the structure above the surface of the water. The structure is connected to anchors in the floor of the body of water by a series of parallel leg members. Each leg member is composed of a plurality of elongated members, such as large diameter pipe usually called risers. These risers are parallel. Vertically spaced spacers are provided along the risers of each leg to (1) maintain the risers a fixed distance apart and (2) change the natural or resonant frequency of the individual riser pipes to be greater than the flutter frequency caused by the motion of the water past the risers.

9 Claims, 2 Drawing Figures

RISER SPACERS FOR VERTICALLY MOORED PLATFORMS

BACKGROUND OF THE INVENTION

1. Field of the Invention

This invention relates to a structure floating on a body of water. More particularly, the invention relates to a floating structure from which drilling or production operations are carried out. In its more specific aspects, the invention concerns a floating structure having buoyancy means for supporting the structure and anchored to the ocean floor by parallel elongated members.

2. Setting of the Invention

In recent years there has been considerable attention attracted to the drilling and production of wells located in water. Wells may be drilled in the ocean floor from either fixed platforms in relatively shallow water or from floating structures or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water, but as the water gets deeper, the problem of design and accompanying cost becomes prohibitive. In deeper water it is common practice to drill from a floating structure.

In recent years there has been attention directed toward the many different kinds of floating structures from which underwater wells can be drilled. One such drilling structure is referred to as the "vertically moored platform" and is described in U.S. Pat. No. 3,648,638, issued Mar. 14, 1972, Kenneth A. Blenkarn, inventor. In the vertically moored platform a structure is supported above the surface of the water by buoyant members. The buoyant members are connected to anchors in the floor by the body of water by long, elongated leg members which are parallel. There are no other anchoring means for the vertically moored platform.

BRIEF DESCRIPTION OF THE INVENTION

This invention concerns a method and apparatus of anchoring a floating offshore structure at a selected location in a body of water having a maximum design wave and current at such location. An anchor base means is provided at the bottom of the body of water at the selected location. Then a plurality of parallel-spaced legs connect the offshore floating structure with the anchor base means. Each of the legs includes a plurality of parallel elongated members, commonly called risers, under tension. A plurality of spacing or centralizing means at vertically spaced intervals is provided for several purposes, including: (1) to hold the elongated members in a fixed position with respect to each other at the level at which the spacing means is provided, and (2) to cause the risers to have a natural frequency different from the flutter frequency. The intervals between the spacing means are set so that the natural or resonant frequency of each individual span of each riser between the spacing means is greater than the maximum anticipated flutter frequency of the corresponding individual span. By the use of this invention the risers are prevented from damaging one another and the potential of fatigue damage in the risers as a result of resonant motion in the risers due to flutter is reduced.

Various objects and a better understanding of the invention can be had from the following description taken in conjunction with the drawings.

DETAILED DESCRIPTION OF THE DRAWINGS

Figure 2:
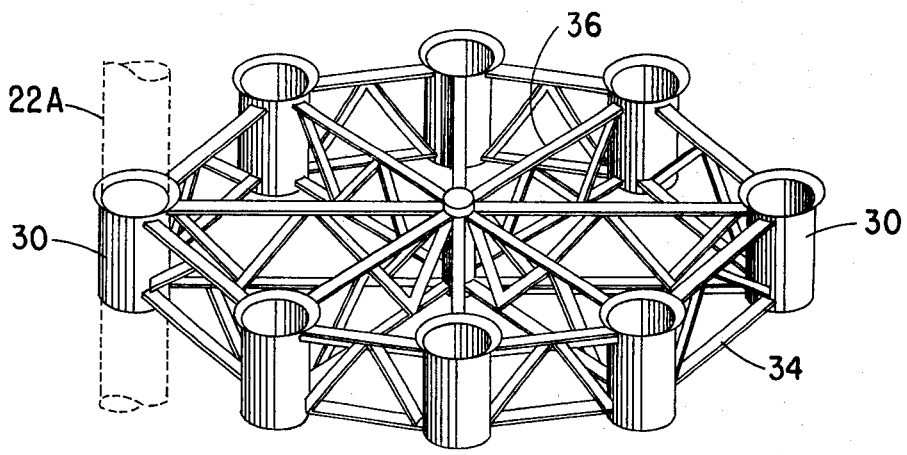
FIG. 2 is an enlarged perspective view of spacer means useful in the device of FIG. 1.

Referring to the drawings as shown, vessel 10 is supported on a body of water 18, having a bottom 16. The structure 10 generally includes a float means 14 which supports a working deck 12 above the surface 26 of the body of water. An anchor means 28 is affixed to the water bottom 16 in any desired manner. The only anchoring means is the legs 20 which connect the floating members 14 with the anchor 28. This is what is commonly called a vertically moored platform and is described in detail in U.S. Pat. No. 3,648,638, supra. Each leg member 20 is composed of a plurality of elongated members or riser pipes 22. Riser pipes are normally made of high quality steel and typically are 20 inches in diameter. Each leg 20 is a group or bundle of several riser pipes 22 which typically vary in number from 4 to 8, depending on design conditions, and extends from its respective float member 14 to the anchor 28. These pipe risers 22 are parallel and are in tension. Typical lengths for these riser pipes 22 may be from 500 feet upward to several thousand feet from the base of the float member 14 of the vertically moored platform to the sea floor 16.

The vertically moored platform is subjected to horizontal motion under the influence of waves, wind and current. Large relative motion of the risers with respect to the water, upward to 50 to 100 feet, may be expected. Centralizers or spacing means 24 are provided along the length of each leg 20. These spacing devices are for two purposes. The first purpose is to maintain the individual tensioned riser pipes parallel and separated at all times so as to prevent one riser from damaging another. As will be explained in greater detail, these centralizing devices 24 are spaced at predetermined vertical intervals such that under the influence of waves and currents, the relative displacement of individual risers 22 within an individual leg 20 will not be sufficient to cause one riser to damage another. The second purpose of the spacers 24 is to force the individual tensioned risers 22 to have a fundamental natural frequency of lateral vibration which is higher than the highest anticipated frequency due to vortex shedding.

Figure 1:
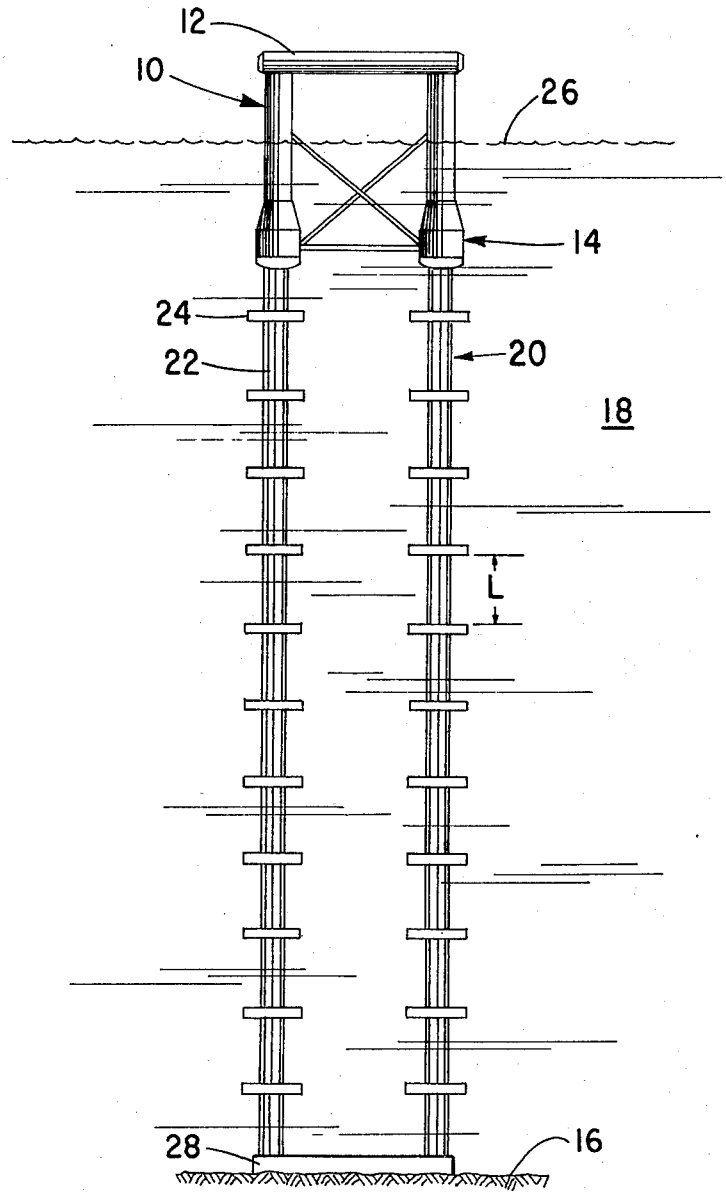
FIG. 1 is a view of a floating structure equipped with this invention.

We will next describe the spacer shown in detail in FIG. 2 and then explain how the correct spacing is obtained to prevent damage when the risers bump into each other and also the potential damage due to fatigue if the resonant frequency of the individual risers is less than the frequency of vortex shedding. Attention is now directed to FIG. 2 which shows in detail the spacer 24 of FIG. 1. Shown thereon are a plurality of sleeve segments 30. These segments 30 fit about the individual riser pipes 22, as indicated by dotted lines 22A in one of the sleeve segments 30. Sleeve segment 30 is fixed to its respective riser 22 by some mechanical means. The individual sleeve segments 30 are braced from each other by braces 34 and by cross radial braces 36. Typically, these sleeve segments 30 are approximately the same size in internal diameter as the external diameter of the riser pipe, which is normally about 20 inches, and the longitudinal dimension would typically be about 3 to 4 feet. Bracings 34 and 36 are typically I-beams or T-beams and are so designed as to add or increase the drag effect to the overall leg system. The centralized risers can flutter as a group. To dissipate this flutter energy a high drag is designed in the spacers. This is done by using small angular members as shown in FIG. 2 and/or by mounting perforated plates or screens on the centralizer. A beneficiary secondary effect of this added drag is to increase damping of platform motions.

SPACING OF CENTRALIZING DEVICES

We shall now give a detailed consideration as to the spacing for the vertical intervals between the centralizing or spacing devices. As mentioned above, one function of the centralizing devices is to keep the riser pipes of each leg apart, that is, when the wave motion causes the riser pipes to want to deflect, the spacing of the centralizer should be close enough so that the riser pipes will not bang into each other, thus causing damage. This can be accomplished by the use of simple beam theory. For example, a structural engineer can use beam theory to determine the deflection of a riser between two supported points, in this case, the spacer element, which is shown in FIG. 2. The spacing devices 24 are spaced sufficiently close vertically so that the lateral spacing of the risers is greater than the calculated relative deflection of the risers. Another criteria is that the maximum deflection of two risers without yield is such that they cannot make contact.

We will next consider the selection of the spacing of the centralizing devices to control the natural frequency of the riser to be higher than the maximum flutter frequency which would develop due to the shedding of von Karman vortices. In many instances, due to the relative motion between the tensioned riser pipes and the surrounding water, lateral flutter of the pipe risers will develop due to the shedding of the von Karman vortices. The frequencies of vortex shedding will normally lock onto the nearest natural frequency of lateral vibration of the tensioned riser. In such an event, flutter will induce resonant lateral motion of the tensioned riser, which, in turn, could result in a large cyclic stressing of the riser and subsequent failure due to fatigue. This will be avoided by our invention. It is shown by classical flutter theory that the flutter frequency is proportional to the relative water particle velocity. Therefore, higher relative velocities are required to develop flutter at higher frequencies. We therefore desire to design a tensioned riser pipe in such a manner that the relative velocity required to set up vortex shedding at the lowest natural frequency of the riser is sufficiently high that it cannot be encountered under normally anticipated conditions. Stated differently, we design the riser pipe for a selected location such that the natural resonant frequency of the riser pipe $F_N$ is greater than the flutter frequency $F_F$. We shall now give a consideration for determining $F_F$ and $F_N$. Equation 1) is generally accepted for determining $F_F$.

1. $F_F = .22\ V/D,$ where

V = relative velocity of the riser and water

D = diameter of the riser.

We then perform the following steps.

a. Calculate the maximum relative velocity at each point along the riser span.

b. Calculate the maximum flutter frequency at each point along the span.

c. Choose the spacer position such that the natural frequency of the individual riser span is larger than the maximum flutter frequency at this point.

In regard to step (a) for example, if the maximum relative velocity of the water with respect to the riser is given approximately by equation (2).

2. $v_{max}(x) = ax,$ where $x$ = distance of a particular point from the bottom of the riser pipe and $a$ = constant.

Then, the maximum $F_F$ is given by the equation (3).

3. $F_F(x) = .22\ a\ x/D.$

Let us assume that the frequency $F_N$ of the individual span of the riser pipe between spacers or centralizers is given by equation (4).

4. $F_N = c/2l.$ where $l$ = length of the span or vertical distance between spacers, $c$ = a constant which is the string wave velocity.

We can develop this equation beginning from a basic equation (5) appearing on page 458 of a book entitled, "Engineering Vibrations", by Jacobsen and Ayre, published by McGraw Hill Book Company, New York, 1958.

$$P_n = \frac{n\pi}{l} \sqrt{\frac{Tg}{W}} \qquad 5$$

where $p_n$ = natural frequency in radians ($\simeq 2\pi F_N$)

T = tension on the riser, $g$ = acceleration of gravity,

W = weight per unit length of the riser.

6. Let $c = \sqrt{Tg/W}$, which is the string wave velocity. By substitution and elimination of $p_n$, we get equation (7).

7. $F_N = nc/2L$ and if we let the length of the span $l = L/n$, where L is the total length of the riser and $n-1$ is the number of spacers or centralizers, then we have 8. $F_N = c/2l.$ We will now discuss the development of an equation for the determination of $l$, the distance between spacers, so that

9. $F_N > F_F.$

By substitution we get $$c/2l > .22\ a\ \frac{x}{D}. \qquad 10$$

$$l < \frac{cD}{.44\ ax}. \qquad 11$$

We would then choose $l$ as follows:

$$l < \frac{cD}{.5\ ax} \qquad 12$$

where $$a \simeq \frac{1}{L} \cdot \frac{\pi}{P} \cdot \frac{H}{2}, \qquad 13$$

where

P = the maximum expected wave period,

H = the maximum expected wave height.

Our main consideration in selecting the spacing of the vertical interval between the centralizing devices is the determination of a spacing which will eliminate flutter or cause $F_N$ to be greater than $F_F$.

While the preferred embodiment has been described in a great deal of detail, it is possible for various variations therein without departing from the spirit or scope of the invention.

We claim:

1. A method of anchoring a floating offshore structure at a selected location in a body of water having a maximum design wave and current which comprises:

providing an anchor base means at the bottom of the body of water;

providing a plurality of parallel spaced legs connecting and anchoring the offshore structure with said anchor base means, each said leg comprising a plurality of parallel hollow elongated anchoring members each under tension;

providing at vertically spaced intervals a plurality of spacing means for holding the elongated anchoring members in a fixed spaced apart position longitudinally and laterally with respect to each other at the level at which the spacing means is provided.

2. A method as defined in claim 1 including the steps of:

determining the flutter frequency of the individual elongated members;

determining the vertical spacing of said spacing means such that the frequency $F_N$ of each individual vertical span between said spacing means is greater than the flutter frequency at the corresponding individual span; and placing the spacing means in accordance with such determination.

3. A method as defined in claim 1 including the step of selecting the vertical spacing l between two adjacent spacing means such that:

$l < cD/.5ax,$ where

D = diameter of the elongated member, $c$ = the string wave velocity, $x$ = distance from the bottom of the body of water and $a = \pi H/2LT$ where P = wave period, H = wave height, L = length of riser.

4. A method as defined in claim 1 including providing drag increasing means on said spacing means to increase drag through said water.

5. A method as defined in claim 2 including providing drag increasing means on said spacing means to increase lateral drag through said water.

6. A method as defined in claim 3 including providing drag increasing means to increase lateral drag through said water.

7. A method as defined in claim 1 including the steps of:

determining the vertical spacing of said spacing means such that the maximum deflection of a riser between two spacing means is less than the lateral spacing of the riser; and placing the spacing means in accordance with such determination.

8. An offshore structure for use in a body of water which comprises:

a platform means;

buoyancy means for supporting said platform means;

an anchor base;

a plurality of parallel legs connecting and anchoring said buoyancy means and said anchor base, each said leg comprising a plurality of parallel elongated anchoring members all under tension; and a plurality of spacing means spaced vertically along each said leg, each spacing means holding the said elongated anchoring members of said leg in a fixed spaced relationship both longitudinally and laterally with each other at the level of such spacing means.

9. An apparatus as defined in claim 8 in which the vertical spacing l between two adjacent spacing means are such that $l < cD/.5ax,$ where D = diameter of the elongated anchoring member, $c$ = the string wave velocity, $x$ = distance from the bottom of the body of water and $a = \pi H/2LT$ where P = wave period, H = wave height, L = length of elongated anchoring member.

* * * * *